United States Patent [19]

Honeycutt, III et al.

[11] Patent Number: 4,955,429

[45] **Date of Patent: * Sep. 11, 1990**

[54] APPARATUS FOR AND PROCESS OF DIRECT CASTING OF METAL STRIP

[75] Inventors: LeRoy Honeycutt, III; James C. Key; Herbert Moody, III, all of Salisbury, N.C.

[73] Assignee: Reynolds Metal Company, Richmond, Va.

[ * ] Notice: The portion of the term of this patent subsequent to May 9, 2006 has been disclaimed.

[21] Appl. No.: 323,018

[22] Filed: Mar. 14, 1989

Related U.S. Application Data

[63] Continuation-in-part of Ser. No. 179,536, Apr. 8, 1988, Pat. No. 4,828,012.

[51] Int. Cl.[5] ..... B22D 11/06

[52] U.S. Cl. ..... 164/479; 164/429; 164/439

[58] Field of Search ..... 164/429, 479, 423, 463, 164/437, 438, 488, 489

[56] References Cited

U.S. PATENT DOCUMENTS 3,431,971 3/1969 Gyöngyös .
4,715,428 12/1987 Johns et al. ..... 164/463
4,749,024 6/1988 Bartlett et al. ..... 164/463
4,751,957 6/1988 Vaught ..... 164/463
4,828,012 5/1989 Honeycutt et al. ..... 164/429

FOREIGN PATENT DOCUMENTS 0147912 7/1985 European Pat. Off. .
60-35220 8/1985 Japan .
622725 4/1981 Switzerland .

*Primary Examiner*—Kuang Y. Lin
*Attorney, Agent, or Firm*—Lowe, Price, LeBlanc, Becker & Shur

[57] ABSTRACT

Disclosed are process and apparatus for use in the direct casting of metal strip from molten metal deposited on a moving chill surface from a tundish having a floor, opposed upwardly extending sidewalls, an end wall, an open outlet opposite the end wall with the open outlet extending substantially the full width of the tundish between the sidewalls, and an inlet for providing a flow of molten metal into the tundish from a source of molten metal. Flow distribution and diffusers within the tundish control and diffuse the flow of molten metal to provide molten metal of substantially uniform temperature across the width of the tundish at the outlet.

23 Claims, 4 Drawing Sheets

FIG. 1
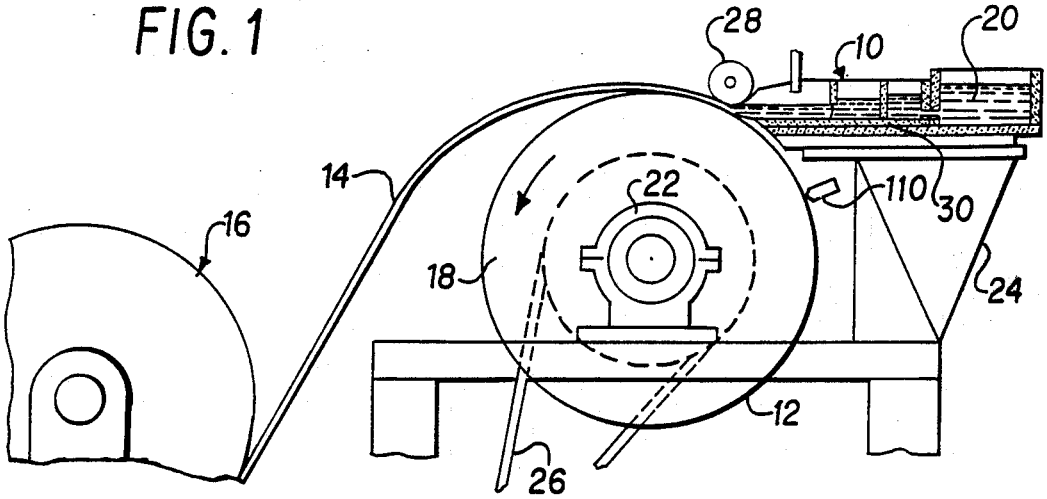
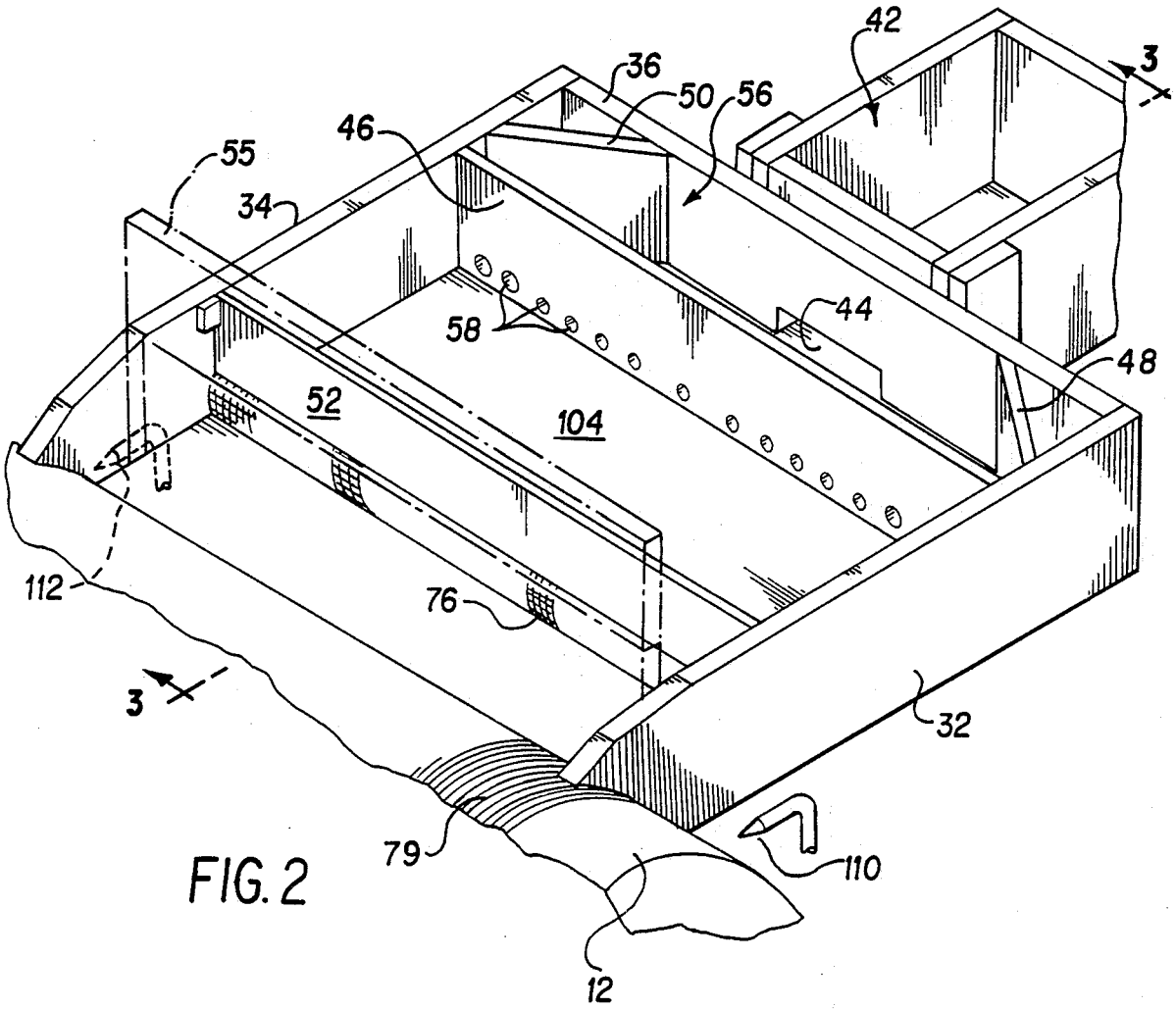
FIG. 2

APPARATUS FOR AND PROCESS OF DIRECT CASTING OF METAL STRIP

This is a continuation-in-part of copending Pat. application Ser. No. 07/179,536, filed Apr. 8, 1988, now U.S. Pat. No. 4,828,012.

BACKGROUND OF THE INVENTION

1. Field of the Invention

This invention relates to process and apparatus for continuous direct casting of metal strip employing a moving chill surface upon which molten metal is flowed for solidification in combination with a tundish or other vessel which receives molten metal and delivers it to the chill surface.

2. Prior Art

The advantages that may be achieved in direct casting of molten metal into thin strip or sheet (hereinafter "strip") on a continuous basis have long been recognized and numerous processes and devices have been proposed for use in direct casting of metal strip. The known processes and devices generally have not been successfully used on a commercial basis, however, particularly for the production of a high quality, wide strip suitable for use in the ascast condition for the production of commercial products, or for further processing as by rolling or shaping by other means.

In prior direct strip casting processes employing a continuously driven chill body having a surface which contacts the molten metal to be cast, the metal is solidified by extracting heat through the chill surface so that a thin skin is formed immediately upon contact with the chill surface. This skin increases in thickness as the chill surface moves progressively through or past the molten metal until the strip is completely formed. The thin skin initially formed is bonded or firmly adhered to the chill surface and the bonded contact results in maximum heat transfer from the molten metal to the chill surface. As the solidifying strip progressively increases in thickness, continued extraction of heat results in contraction of the strip at its bonded interface with the chill surface until the bond is broken, thereby resulting in a substantial reduction in the rate of heat extraction.

The successful production of quality strip by the process outlined in the preceding paragraph depends to a large degree upon the extraction of heat across the full width of the strip at a rate which will obtain a uniform release of the cast strip from the chill surface. One process for obtaining the required uniform strip release is disclosed and claimed in copending U.S. Pat. application Ser. No. 263,074, assigned to the assignee of the present application. That process involves establishing a natural oxide layer on the chill surface and maintaining the natural oxide interface in a smooth layer of substantially uniform thickness. The natural oxide layer is maintained in the required condition by engaging and polishing the natural oxide layer which is formed as a result of exposure of the chill surface to atmosphere and to the metal being cast. The polishing is effective only to remove the outermost particles of the oxide layer while leaving a packed layer of natural oxide firmly adhered to the chill surface.

Efforts to produce direct cast strip in commercially acceptable widths have revealed problems which are not encountered in the production of more narrow strips on laboratory or experimental apparatus. One problem involves a chill body which extracts heat from the strip being formed which will normally be substantially wider than the width of strip to be cast, and in a commercial installation, the capital cost will dictate that the chill body and other apparatus be capable of operation to produce strip of various widths. Cooling fluid used to cool the chill body will cool the portion of the chill surface which does not contact the molten metal during operation, and this, in turn, will further reduce the temperature of that portion of the chill surface which contacts the edge portions of the strip being cast. This tends to produce more rapid cooling at the strip edges and can result in increased strip thickness at the edges and a reduction of strip thickness adjacent the thickened edge. The non-uniform strip cross section resulting from the phenomena is sometimes referred to as a "dog bone" shape.

Obtaining a uniform strip release requires the delivery of molten metal to the chill surface at a temperature which is substantially uniform across the full width of the strip. In the production of metal strip in commercial widths, the molten metal tends to channel, or flow at non-uniform rates through the molten metal supply vessel (hereinafter, tundish) with the result that, in areas of most rapid flow, the temperature of the metal reaching the chill surface is higher than in the areas of slower flow. Even small temperature variations of the molten metal contacting the chill surface are manifested in strip thickness variations, and the problem tends to increase with increased strip width.

Numerous tundish designs are disclosed in the prior art but these known tundish designs, generally, do not recognize the problems encountered in commercial operations and consequently do not suggest any solution to the problems. Typical prior art patents disclosing open tundish designs intended for use in the direct casting of metal strip on a moving chill surface include U.S. Pat. Nos. 4,715,428 and 4,751,957; European Pat. Application No. 0147912; Swiss Pat. No. 622,725; and Japanese Published Application No. 5,035,220. Also U.S. Pat. No. 3,431,971 discloses a tiltable open tundish for continuous casting of metal plate in a rotatable wheel type mold.

Of the above patents, U.S. Pat. No. 4,715,428 is specifically directed to tundish design and discloses a tundish having an open, generally U-shaped outlet. The tundish gradually decreases in depth and increases in width from its inlet to its outlet, and the patent suggests that plates 36, partially submerged in the molten metal, may be employed to facilitate development of uniform flow. These plates are used in baffling or dampening the flow to obtain uniformity of flow across the full tundish width and to restrain movements of surface oxides and slag. It is not suggested, however, that the plates 36 can reduce channeling or the effect of temperature variations at the tundish outlet.

It is accordingly, a primary object of the present invention to provide a novel tundish structure for use in the direct casting of thin metal strip.

Another object of the present invention is to provide a novel tundish structure for containing and supplying molten metal to a moving chill surface for producing a strip of commercially acceptable widths and of substantially uniform thickness throughout its width.

Another object of the invention is to provide a novel tundish structure for containing a supply of molten metal and or conducting the molten metal by gravity flow into contact with a moving chill surface in a manner to present molten metal to the chill surface at a substantially uniform temperature throughout substantially the full width of the strip being cast.

Another object is to provide such a tundish including means for compensating for unavoidable molten metal and chill surface temperature variations across the width of a strip being cast.

Another object is to provide a tundish which is economical to construct and maintain and which is reliable in operation and service.

SUMMARY OF THE INVENTION

The foregoing and other features and advantages of the present invention are obtained by a novel tundish structure and process in which the tundish is supported in a fixed position adjacent a rotating chilled casting wheel surface for supplying molten metal to be cast to the moving chill surface. Molten metal is supplied from a supply chamber to the tundish through a submerged inlet. Flow control and distribution means are provided for diverting and distributing the incoming stream across the full width of the tundish.

Diffusion means are preferably provided for diffusing the molten metal downstream from the flow control and distribution means to eliminate channeling and to produce a substantially uniform flow rate through the tundish throughout its width as the metal approaches the chill surface. Obtaining uniform flow rate across the width of the tundish results in molten metal of a substantially uniform temperature being presented to the chill surface for the production of a more uniform commercially acceptable strip.

Means are also provided for compensating for the tendency of the chill surface to extract heat at a greater rate adjacent the edges of the strip. This may be accomplished by reducing slightly the depth of metal presented at the edges of the tundish lip by increasing slightly the thickness of the lip adjacent the edges of the strip. Alternatively, means may be provided for heating the chill surface in areas adjacent the edges of the strip prior to contact of the chill surface with the molten metal.

BRIEF DESCRIPTION OF THE DRAWINGS

The foregoing and other features and advantages of the present invention will be apparent from the following detailed description taken in conjunction with the accompanying drawings, in which:

FIG. 1 is a schematic view, in elevation and partly in section, of a direct casting apparatus embodying the principles of the present invention;

FIG. 2 is a three-dimensional view of a portion of the apparatus shown in FIG. 1;

DESCRIPTION OF THE PREFERRED EMBODIMENT

Figure 3:
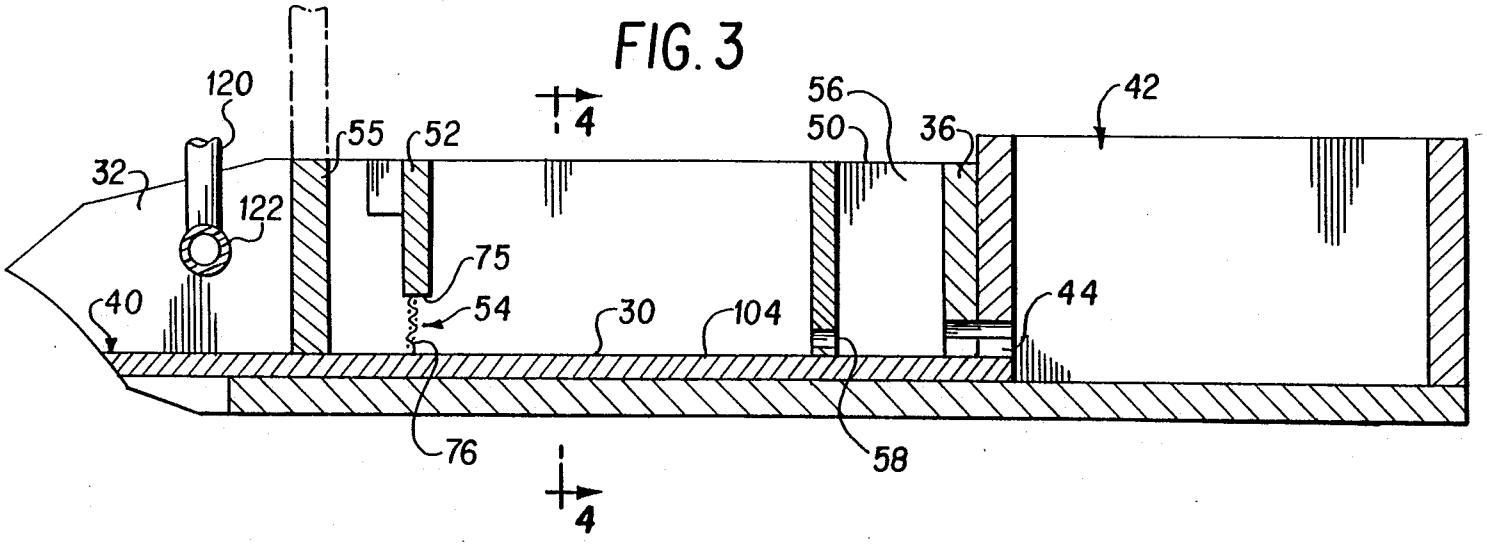
FIG. 3 is a view in section taken along the line 3—3 of FIG. 2.
Figure 4:
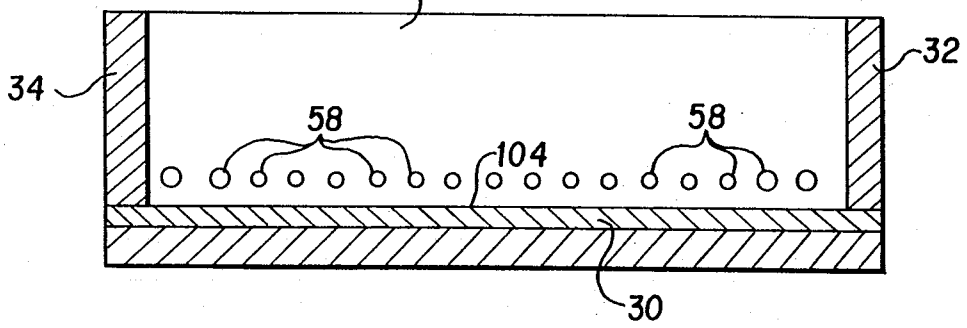
FIG. 4 is a view in section taken along the line 4—4 of FIG. 3.
Figure 5:
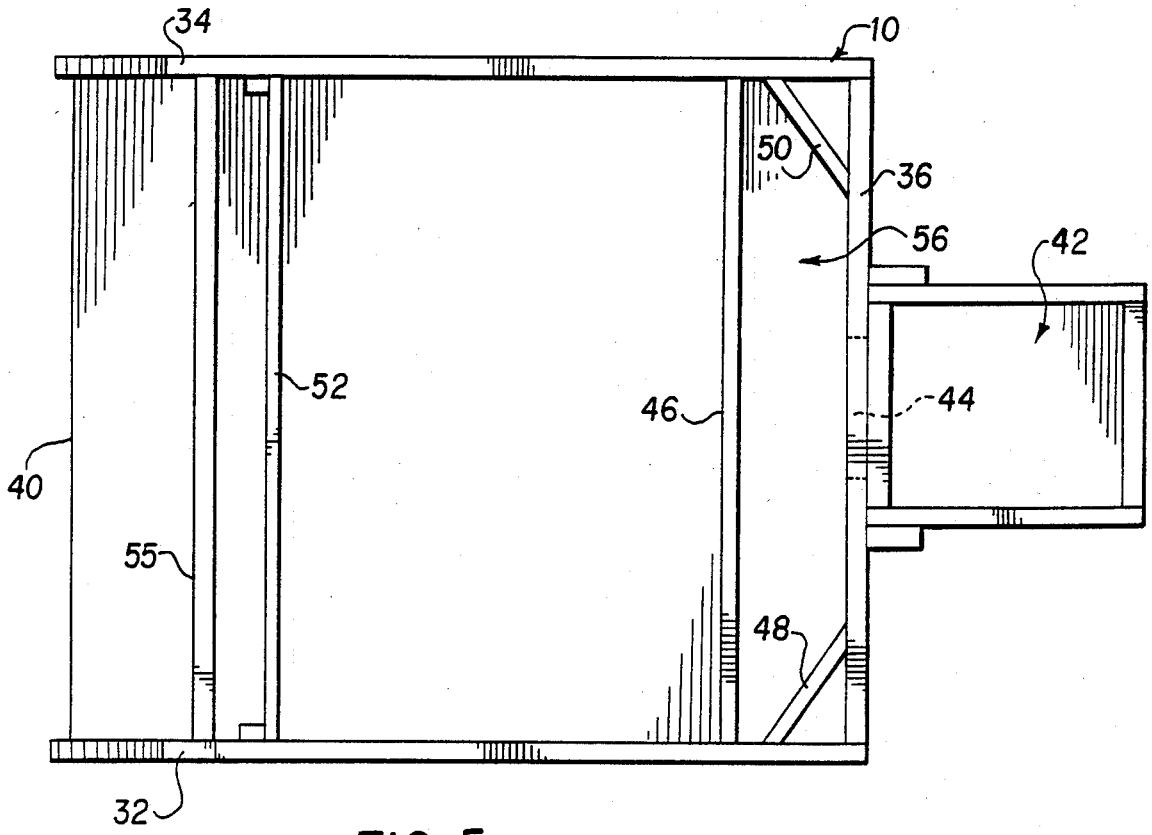
FIG. 5 is a plan view of a portion of the apparatus shown in FIG. 2.

A direct casting apparatus suitable for use in practicing the present invention is schematically shown in FIG. 1 of the drawings. As shown, a tundish 10 is located in close proximity to the chill surface 12 of a casting wheel upon which molten metal is solidified as strip 14 which is withdrawn from the casting apparatus and coiled in a conventional manner on coiler 16.

The chill surface 12 comprises the external cylindrical surface of a casting wheel 18. The casting wheel 18 is internally cooled with circulating water or other cooling liquid to rapidly extract heat through the chill surface 12 to quench and solidify molten metal 20 provided by the tundish and contacting the chill surface 12 as the casting wheel rotates upwardly through the molten metal. The chill surface 12 is preferably grooved or roughened as shown in U.S. Pat. Nos. 3,345,738 and 4,250,950.

Suitable means such as journal bearings 22 support casting wheel 18 for rotation about a fixed horizontal axis on a rigid supporting frame 24. Suitable drive means such as a variable speed motor and reduction gear mechanism, not shown, and a drive chain or belt 26 are provided to rotate the casting wheel about its fixed horizontal axis. The exit end of the tundish is located in close proximity to the chill surface 12 and molten metal from the tundish is flowed over a transverse lip into contact with the moving chill surface. The apparatus may also include a top roll 28 which is uncooled or heated and mounted for rotation in contact with molten metal prior to complete solidification of the strip. Details of the top roll process and apparatus are disclosed and claimed in copending PCT/US Application Ser. No. 88/04641, filed Dec. 29, 1988 for APPARATUS FOR AND PROCESS OF DIRECT CASTING OF METAL STRIP, which application is assigned to the assignee of the present application.

As shown in FIGS. 2, 3, 4 and 5, the tundish 10 provided by the present invention includes a floor 30, laterally spaced upwardly extending opposed parallel sidewalls 32 and 34, a rear end wall 36 and an open end which is effectively closed by the chill surface 12. The floor 30 terminates at the open end of the tundish in a transversely extending contoured lip 40. Molten metal is flowed to the tundish 10 from a supply or surge chamber 42 through a submerged inlet port 44 formed in a wall of the supply chamber 42 and in the end wall 36, molten metal being supplied to the chamber 42 by any suitable means such as a ladle or hot metal transfer system from a melting furnace. A first upwardly extending wall 48 extends from sidewall 32 to the end wall 36 and is connected thereto at a point outboard of the lateral edge of inlet port 44, and a similar wall 50 extends from sidewall 34 to end wall 36 and is joined thereto outboard of the other lateral edge of the inlet port 44. Walls 48, 50 thus extend in diverging relation from points adjacent to the inlet port 44 to the parallel sidewalls 32 and 34 and cooperate therewith to define the metal containing chamber of the tundish, with the diverging walls 48 and 50 being disposed to eliminate or minimize areas of stagnant liquid metal during operation.

The tundish 10 includes a novel combination of means for dividing, diverting and diffusing molten metal in the tundish to obtain the objects of the present invention, which objects include control of the rate of flow of the molten metal onto the chill surface across the transverse width of the tundish lip, control of the temperature of the molten metal transversely of the tundish lip, and providing controlled minimized turbulence of the molten metal discharged from the tundish.

This facilitates control of the strip gauge and transverse shape by enabling delivery of molten metal at a more uniform temperature and a more uniform heat transfer through the chill across the full width of the strip being formed to thereby reduce longitudinal cracks and improve the gauge, shape and quality of the cast strip. The molten metal flow control means of the combination includes a distribution plate 46, the diverging walls 48 and 50, and a flow restricting wall or dam 52 presenting a submerged opening 54 adjacent to the tundish floor and extending across the full transverse width of the tundish between the sidewalls 32 and 34.

The molten metal distribution plate 46 extends between sidewalls 32, 34 at the downstream ends of diverging walls 48, 50, and has its bottom edge in contact with and joined to the top surface of the tundish bottom wall 30. Plate 46 cooperates with diverging walls 48, 50 and end wall 36 to form an inlet compartment 56 in the tundish 10 for receiving molten metal flowing through inlet 44 from the supply chamber 42. A plurality of openings 58 formed in plate 46 adjacent to its bottom edge control the flow of molten metal from the inlet compartment 56. The number and size of flow control openings 58 are such as to restrict the flow of molten metal so that the openings are all completely submerged during operation. The flow restriction produces a head loss, resulting in the level of molten metal being greater on the upstream side of plate 46 during casting.

The distribution of the openings 58 along the length of plate 46 are such as to produce a greater flow restriction in the central area of the tundish than in the areas adjacent the sidewalls 32, 34. This results in the liquid metal flowing in a generally fan-shaped pattern from inlet 44 through chamber 56 so that stagnant or cold spots are essentially eliminated. The reduced flow resistance resulting from an increased number or size of openings 58 nearer the tundish sides thus assures a substantially uniform flow rate and temperature of molten metal across the full width of the tundish at the downstream side of the plate 46. Also, since openings 58 are submerged during operation, plate 46 acts as a skimmer, holding back oxides or other matter floating on top of the metal in inlet chamber 56.

The flow control wall 52 is positioned downstream of the diverging walls 48, 50 and the distribution plate 46, and extends across the full transverse width of the tundish with its bottom edge 75 spaced above the top surface of the floor 30. The opening 54 between the bottom edge 75 and floor 30 is preferably slightly less than the maximum depth of liquid metal downstream of the wall 52 during a casting operation. A flow diffuser means 76, preferably in the form of a screen, extends over the open space between the top surface of floor 30 and the bottom edge 75 of transverse wall 52 to provide uniform flow diffusion across the transverse width of the tundish during operation. At the same time, the screen 76 also acts as a flow restrictor which, in combination with the positioning of the wall 52, may result in the level of metal upstream of the wall being above the bottom edge 75 so that the wall acts as a skimmer, holding back oxides or other foreign material floating on the surface of the molten metal and producing a slight head differential across the screen which results in a more uniform, diffused flow of metal from beneath the layer of oxide. The diffusion effect of the screen, as well as of submerged openings 58 in plate 46 produce light turbulence in the form of small eddies which effectively prevent channeling of liquid metal and provide a more uniform flow to minimize any temperature differential across the width of the tundish at the contoured lip 40. Turbulence produced by the diffusion screen 76 and flow control openings 58, however, is not great enough to cause mixing of floating oxides, slag or other impurities with the liquid metal flowing through the tundish.

A flow control gate 55 is mounted for vertical sliding movement between the sidewalls 32, 34 downstream of the wall 52. Gate 55 is adapted to be moved from a lowered position in which its bottom edge engages the top surface of floor 30, completely preventing the flow of metal to the contoured lip 40, and a raised position permitting free flow to the chill surface 12. In the raised position, gate 55 may be out of contact with the molten metal but preferably has its bottom edge slightly below the metal surface to act as a final skimmer.

Figure 6:
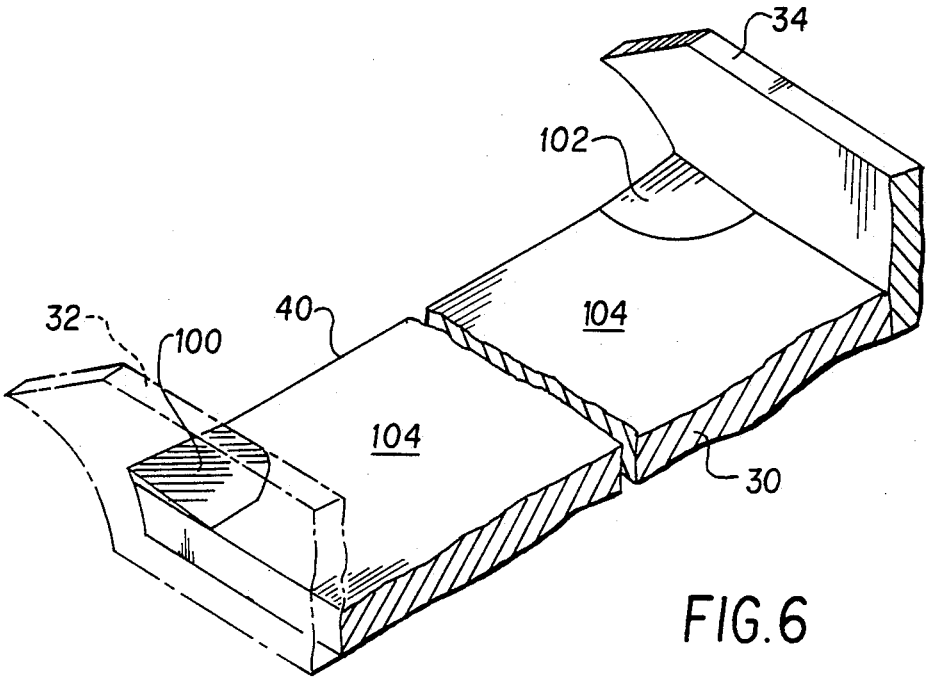
FIG. 6 is a three-dimensional view of a detail of the apparatus of FIG. 2.
Figure 7:
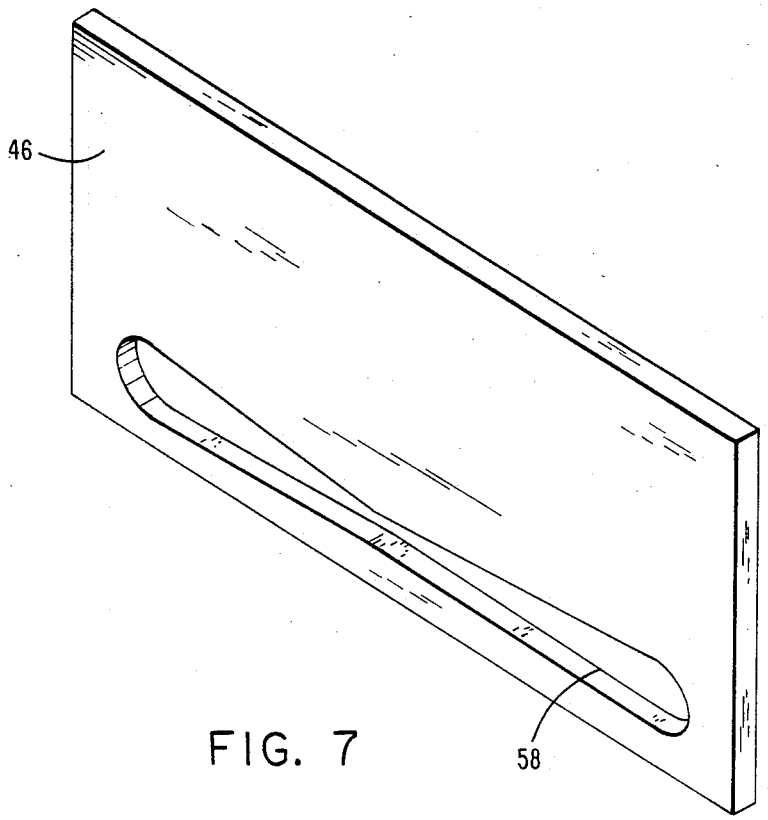
FIG. 7 is a three-dimensional view of an alternative embodiment of the flow obstructing wall in the apparatus of FIG. 2.

As discussed above, in operation of a typical direct casting system employing a casting wheel presenting a chill surface, coolant circulated through casting wheel 18 cools a portion of the chill surface 12 at each end of the casting wheel which does not contact the molten metal during casting. This condition tends to cool the portion of the chill surface which contacts the marginal edges of the strip more than the portion contacting the central portion of the strip. Thus, despite the delivery of molten metal to the chill surface at a substantially uniform temperature across the full width of the tundish, such uneven cooling of the chill surface can result in an increased thickness of the marginal edges of the strip which, in turn, can cause problems in coiling the strip and may require the excessive edge trimming and a consequent production loss. It has been found that this problem may be overcome or substantially avoided without excessive loss of product and without adversely affecting the quality of the cast strip. This may be accomplished by slightly reducing the depth of metal delivered to the chill surface at the strip edges. By increasing the thickness of the transverse lip 40 of the tundish adjacent to the sidewalls 32, 34, the contact time between the molten metal and the chill surface adjacent the marginal edges of the strip is reduced and the strip thickness in this area is similarly reduced. As shown in FIG. 6, this may be accomplished by providing a pair of thin inserts or risers 100, 102 located on and bonded to the top surface 104 of the floor 30, one adjacent each sidewall 32, 34 at the lip 40, that is, at the corners defined by the sidewalls and the lip.

Risers 100 and 102 preferably are of generally rectangular configuration in both longitudinal and transverse cross section to provide maximum thickness at the point of intersection of the front lip, and taper both longitudinally and transversely from this point of maximum thickness to smoothly blend into the top surface 104 of the floor. The thickness as well as the longitudinal and transverse dimensions of risers 100 and 102 will be determined by various factors including the rate of casting, the depth of metal in the tundish and the temperature of the molten metal which flows over the top surface of the lip.

The present invention also contemplates overcoming the "dog bone" effect without sacrificing product by the application of heat to an area of the chill surface adjacent to but outboard of the marginal edges of the chill surface which contacts the molten metal. Such application of heat reduces or eliminates the more rapid cooling along the marginal edge portion of the strip with the advantages outlined above. The heating may be accomplished by providing a pair of gas burners 110 and 112 in position to direct a flame or a jet of hot gas onto the chill surface at a location outboard of and adjacent to the portion which contacts the molten metal forming the edges of the strip. The heat is preferably applied to the chill surface of the casting wheel at a location beneath the tundish and just prior to contact with the molten metal, and sufficient heat is applied to compensate for or overcome the chilling effect on the strip normally produced by the cold marginal edges of the chill surface. The area to which the heat is applied and the intensity and quality of heat used will, of course, be determined by various factors including the casting rate, strip thickness and the temperature of the molten metal. The edge thickness can thus be easily controlled during operation by varying the heat applied to the chill surface through adjustment of the intensity and position of the heat applied by the burner.

It should be understood, of course, that chill surface heating and tundish risers may be employed independently of one another or in combination, as required, to overcome the "dog bone" effect and produce strip of the desired commercial quality with minimum waste from edge trimming. The use of the two systems together provides a convenient and economical means for accurately controlling the "dog bone" effect.

A tundish described above and shown in FIGS. 2, 3, 4, 5 and 6 has been constructed and operates with a rotatable, cooled wheel for the production of 30 inch wide commercial quality aluminum strip. The casting wheel presented a chill surface provided with generally circumferential grooves 79. The casting wheel had a diameter of 27.635 inches and a steel chill surface 42 inches wide. The free ends of the opposed sidewalls 32 and 34 were contoured to be compatible with the external surface of the casting wheel and the transverse dimension between the sidewalls 32 and 34 was 30 inches, i.e., the width of the strip to be cast. The tundish floor and walls were constructed utilized Pyrotek and ceramic boards for thermal insulation, and were reinforced with structural members for stability and structural integrity. The tundish included a horizontal floor 30 having a length of 38 inches between end wall 36 and lip 40, and the sidewalls were 5 inches high. A supply chamber 42 was provided adjacent end wall 36, and the inlet port 44 between the supply chamber and the tundish was 6 inches long, had a vertical dimension of 1 inch and was disposed symmetrically about the longitudinal vertical centerplane of the tundish with its bottom edge in the plane of the floor 30. The distribution plate 46 was positioned 4 inches from the back wall 36 and had a total of fifteen flow control openings 58 including eleven circular openings having a diameter of $\frac{3}{8}$ inches and four circular openings having a diameter of $\frac{5}{8}$ inches. The openings were located in symmetrical patterns on each side of the vertical longitudinal centerplane of the tundish, with one $\frac{3}{8}$ inch opening located on the centerplane and two $\frac{5}{8}$ inch openings located 1 inch and 2 inches, respectively, from each sidewall. All openings 58 had their centers approximately $\frac{1}{2}$ inch above the top surface 104 of floor 30. Wall 52 was located approximately 23 inches downstream from the flow control wall. A $\frac{1}{4}$ inch mesh fiberglass screen diffuser 75 extended from the bottom of wall 52 to the floor 30. Flow control gate 55 was located approximately 4 inches downstream from wall 52.

The inserts or risers 100, 102 located in the corners of the sidewalls and the lip, had a maximum vertical thickness of $\frac{1}{4}$ inch and were tapered to feather into the surface 104 of the tundish at the lip 2 inches from the sidewalls.

In operation of the tundish constructed in the manner described above, the gate 55 is moved to the closed position and molten metal is supplied to chamber 42 and permitted to flow through opening 44into the tundish until the metal in the tundish reaches a level required to cast a strip of the desired thickness. The gate 55 is then moved to the open position to permit free flow of the molten metal through the tundish and into contact with the chill surface 12 of the driven casting wheel 18. When equilibrium conditions are established, molten metal flows from the supply chamber 42 through the entry port 44 into chamber 56. Flow restriction provided by the openings 58 causes a buildup in chamber 56 until the level stabilizes at a level above the openings 58 and above the level downstream of plate 46, i.e., between plate 46 and wall 52. The size and distribution of the openings 58 effectively control the flow of liquid metal, producing a plurality of submerged low velocity streams which combine to produce a substantially uniform flow rate between plate 46 and wall 52 across the full width of the tundish. The submerged openings 58 also enable plate 46 to act as a skimmer to hold back oxides and impurities floating on top of the molten metal, thereby producing an "underflow" resulting in a more uniform velocity of the streams through the tundish.

The composite stream then flows through the screen 76 in the opening 54 beneath wall 52 which provides slight but substantially uniform turbulence acting to diffuse the stream across its full width. This results in a more uniform flow and temperature throughout the transverse width of the tundish between the sidewalls 32 and 34 at the lip 40. The effect of any slight flow differential produced by friction with the sidewalls 32 and 34, and any slight temperature variation resulting therefrom, are compensated for by use of the risers 100 and 102 which substantially eliminate the "dog bone" effect.

Flow restrictions provided by the distribution plate 46 and by the wall 52 and its associated diffuser screen 76 produce head variations between the inlet chamber 56, the portion of the tundish upstream of wall 52 and the portion downstream of wall 52. The flow diffusers help compensate for minor head level fluctuations and produce a more uniform molten metal level at the tundish lip 40.

A cover (not shown) for the top of the tundish is preferably employed to provide an enclosure for receiving and containing an inert atmosphere. An inert gas from a source (not shown) may be fed by conduit 120 to an internal manifold 122 for discharging inert gas into the enclosure.

The apparatus just described has been employed to produce commercial quality aluminum strip. In one such run, aluminum strip 30 inches wide and having a substantially uniform thickness of 0.045 inches was produced. The transverse profile was substantially uniform and free of the "dog bone" effect. The strip was trimmed to remove 1 inch from each side, and rolled on commercial rolling mill equipment to produce commercial grade aluminum foil having a thickness of 0.00025 inches.

It has been found that water modeling can be employed to determine the most advantageous flow control or metering opening size and pattern for the flow distribution plate, thereby eliminating or greatly reducing the need for expensive and time-consuming experimental testing using molten metal. Temperature measurements made adjacent the lip 40 during casting of 30 inch wide aluminum alloy 3105 showed a uniform temperature across the full width of the tundish within a range of ±2° F. with the maximum deviation being adjacent to the tundish sidewalls. Tests have also shown that, in casting such aluminum strip having a nominal thickness of about 0.040 inches, a temperature variation of 10° F. will result in a strip thickness change of approximately 0.001 inch.

It is believed apparent that numerous factors will influence the design and construction of the tundish according to the present invention. These factors may include the type of metal, or alloy, being cast, the width and thickness of the strip to be cast, and the casting speed. Thus, for casting 30 inch aluminum strip having a thickness of up to about 045 inches, the configuration described has been found satisfactory; however, for casting wider strip, it may be desirable to provide multiple inlets to the tundish or to provide baffles to assist in distributing the metal flow uniformly across the width of the tundish.

It is believed apparent that various modifications to the structure may be made. For example, multiple diffusion members and/or multiple flow distribution means may be employed. Also, the diffusion wall 52 and screen 76 may be replaced with a second flow distribution plate similar in construction to plate 46. In such an arrangement, it is also contemplated that a movable plate forming a gate or valve member may also be used to alter the size of openings in one or both flow control plates to provide more flexibility of operating parameters such as strip thickness and casting speed. It is also contemplated that a single elongated opening dimensioned and contoured to produce the required flow may be used.

Diffusion means such as screen may be employed to provide different flow restrictions across the width of the tundish, particularly in the casting of wider strips.

While the invention has been described with respect to a melt drag casting process in which a cylindrical, internally cooled casting wheel is employed as a chill, other chill configurations such as a continuous belt or a caterpillar track casting surface may be employed in such process. It is also contemplated that the process and apparatus may be employed to cast the thin metal strip on a previously formed thin metal substrate to produce a composite material or to provide a uniform flow of metal to a twin chill casting apparatus. Thus, while a preferred embodiment of the invention has been disclosed and described, it should be understood that the invention is not so limited but rather that it is intended to include all embodiments which would be apparent to one skilled in the art and which come within the spirit and scope of the invention.

What is claimed is:

1. In a process for direct casting of molten metal to form strip by solidification of molten metal on a moving chill surface using a vessel having a floor, spaced sidewalls, an inlet, and an outlet opposite the inlet and extending between the sidewalls for supplying molten metal to the chill surface, the improvement comprising the steps of:

positioning the vessel with the outlet adjacent the chill surface;

providing a source of molten metal to be cast;

withdrawing at least one inlet stream of molten metal from the source and flowing the inlet stream into the vessel through the inlet;

providing a flow obstruction in the vessel in the path of the inlet stream;

utilizing the flow obstruction to divert and distribute the inlet stream to provide a substantially uniform rate of flow of liquid metal through the vessel across its full width downstream of said obstruction means; and diffusing the molten metal flowing through the vessel downstream of the flow obstruction to provide molten metal at a substantially uniform temperature at the vessel outlet across the full width of the outlet.

2. The process according to claim 1 wherein the step of providing a flow obstruction includes positioning a transversely extending wall member in the vessel acting as a dam obstructing the flow of metal, and providing limited submerged flow through the wall member between the vessel sidewalls, the wall member acting as a skimmer to prevent the passage of impurities floating on the metal.

3. The process according to claim 2 wherein the submerged flow is provided by a system of openings through the wall member, the openings being spaced and dimensioned to provide the substantially uniform flow rate.

4. The process according to claim 2 wherein the step of diffusing the molten metal comprises flowing the molten metal through a submerged porous diffusion medium extending between the sidewalls of the vessel.

5. The process according to claim 4 wherein the porous diffusion medium comprises a screen member extending over and covering an opening defined by the vessel bottom wall, the sidewalls, and a skimmer wall extending above the bottom wall and having a bottom edge submerged in the molten metal.

6. The process according to claim 5 further comprising the step of providing a gate upstream of the vessel outlet and moving the gate from a closed position stopping the flow of molten metal through the vessel and an open position permitting molten metal to flow to the outlet, the gate in its open position being partially submerged to act as a skimmer holding back impurities floating on the molten metal.

7. The process defined in claim 4 wherein said floor has a substantially horizontal surface adjacent said outlet, and further comprising the step of providing a reduced depth of metal flowing from said outlet adjacent each sidewall portion only of the vessel.

8. The process defined in claim 4 wherein the chill surface is in the form of a cooled cylindrical wheel surface rotated adjacent said outlet, said chill surface extending outwardly from said sidewalls on each side of the vessel, the process further comprising the step of applying heat to the chill surface in the area of the vessel sidewalls and outboard of the outlet.

9. The process defined in claim 8 wherein said floor has a substantially horizontal surface adjacent said outlet, and further comprising the step of providing a reduced depth of metal flowing from said outlet adjacent each sidewall portion only of the vessel.

10. In a tundish for use in direct casting of metal strip by solidification of molten metal on a moving chill surface, said tundish including a floor, an end wall, a pair of laterally spaced sidewalls, an outlet opposite said end wall and having a transverse discharge surface extending between said sidewalls for flowing a stream of molten metal onto the moving chill surface, means providing a source of molten metal to be cast, and an inlet in said end wall communicating with said source for directing a flow of molten metal from the source into the tundish in a direction toward said outlet, said inlet being located at a level below the level of molten metal in the tundish during casting, the improvement comprising flow obstructing wall means extending transversely of said tundish between said sidewalls at a location downstream of said send wall, flow distribution opening means extending through said flow obstructing wall means at a location below the level of molten metal during casting whereby said flow obstructing wall means acts as a skimmer for impurities floating on the molten metal during casting, said opening means being located and dimensioned to provide a submerged flow path for molten metal through said flow distributing wall means at a substantially uniform rate across the width of said tundish between said sidewalls downstream of said flow obstructing wall means, and flow diffusing means in said tundish downstream of said flow obstructing means, said diffusing means extending upwardly from said bottom wall across the full width of said tundish between said sidewalls and providing a substantially uniform array of openings across the full width of the tundish, said array of openings being dimensioned and located to diffuse the flow of molten metal to provide molten metal at a substantially uniform temperature at the tundish outlet across the full width of the tundish.

11. The tundish defined in claim 10 wherein said flow distribution opening means comprises a plurality of laterally spaced openings formed in and extending through said transverse wall adjacent to said vessel floor.

12. The tundish defined in claim 10 wherein said diffusing means comprises a skimmer wall extending transversely of said vessel between said sidewalls and having a bottom edge spaced above said floor, and a porous diffuser member extending between said bottom edge and said floor.

13. The tundish defined in claim 12 wherein said skimmer wall bottom edge is spaced from said floor a distance less than the normal depth of molten metal flowing through the vessel during casting whereby said skimmer wall acts as a skimmer for impurities floating on the top of the molten metal.

14. The tundish defined in claim 13 wherein said porous diffuser member comprises a screen having a pattern of openings to diffuse the molten metal flowing therethrough.

15. The tundish defined in claim 10 further comprising a gate mounted upstream of said outlet, said gate being supported for movement between a closed position preventing the flow of molten metal to said outlet and an open position permitting substantially free flow of molten metal during casting.

16. The tundish defined in claim 10 wherein said floor terminates in a transverse edge at said outlet and has a substantially horizontal top surface adjacent said transverse edge, the vessel further comprising riser means on said floor adjacent said transverse edge and each said sidewall, said riser means having a top surface extending above the floor surface to thereby reduce the depth of molten metal flowing from said outlet in the areas adjacent said sidewalls, said horizontal top surface extending substantially throughout the width at said outlet between, said risers.

17. The tundish defined in claim 16 wherein the top surface of each riser means is inclined transversely to intersect the substantially horizontal surface along a line spaced from the adjacent sidewall.

18. The tundish defined in claim 11 wherein said diffusing means comprises a skimmer wall extending transversely of said vessel between said sidewalls and having a bottom edge spaced above said floor, and a porous diffuser member extending between said bottom edge and said floor.

19. The tundish defined in claim 18 further comprising a gate mounted upstream of said outlet, said gate being supported for movement between a closed position preventing the flow of molten metal to said outlet and an open position permitting substantially free flow of molten metal during casting.

20. The tundish defined in claim 19 wherein said skimmer wall bottom edge is spaced from said floor a distance less than the normal depth of molten metal flowing through the vessel during casting whereby said skimmer wall acts as a skimmer for impurities floating on the top of the molten metal.

21. The tundish defined in claim 10 wherein said flow distribution opening means comprises a single elongated, transversely extending opening through said flow distribution wall means.

22. The tundish defined in claim 21 wherein said single opening is contoured across the width of said tundish to provide a greater opening area adjacent said sidewalls.

23. The tundish defined in claim 11 wherein said plurality of openings are dimensioned and arranged to provide an increased opening area of reduced flow restriction adjacent said sidewalls.

* * * * *